United States Patent [19]

Zahn

[11] Patent Number: 4,564,959

[45] Date of Patent: Jan. 21, 1986

[54] CRASH HELMET

[75] Inventor: Christian Zahn, Brunswick, Fed. Rep. of Germany

[73] Assignee: Schuberth-Werk GmbH & Co. KG, Brunswick, Fed. Rep. of Germany

[21] Appl. No.: 616,134

[22] Filed: Jun. 1, 1984

[30] Foreign Application Priority Data

Jun. 4, 1983 [DE] Fed. Rep. of Germany ..... 3320301

[51] Int. Cl.[4] ..... A42B 3/00

[52] U.S. Cl. ..... 2/411; 2/410; 2/425; 2/6; 2/184.5

[58] Field of Search ..... 2/410, 411, 412, 424, 2/425, 6, 171, 184.5, 195, 196

[56] References Cited

U.S. PATENT DOCUMENTS

| | | | |
|---|---|---|---|
| 2,081,335 | 5/1937 | Levinson | 2/412 |
| 3,548,410 | 12/1970 | Parker . | |
| 3,551,911 | 1/1971 | Holden | 2/411 |
| 3,783,450 | 1/1974 | O'Connor | 2/425 X |
| 3,927,421 | 12/1975 | Simon . | |
| 4,075,714 | 2/1978 | Ryder et al. | 2/425 X |

FOREIGN PATENT DOCUMENTS

| | | | |
|---|---|---|---|
| 235033 | 12/1963 | Austria . | |
| 0090720 | 10/1983 | European Pat. Off. | 2/411 |
| 7607301 | 12/1976 | Fed. Rep. of Germany . | |
| 2313879 | 1/1977 | France . | |
| 730121 | 5/1955 | United Kingdom . | |
| 2048056 | 12/1980 | United Kingdom . | |

*Primary Examiner*—Henry S. Jaudon
*Assistant Examiner*—J. L. K. Olds
*Attorney, Agent, or Firm*—Schwartz, Jeffery, Schwaab, Mack, Blumenthal & Evans

[57] ABSTRACT

Disclosed is a crash helmet with a substantially spherical cap part wherein a reduction of the forces acting on the helmet at high speeds is obtained by providing the surface of the cap with a plurality of topographical irregularities or surface unevennesses arranged adjacently to each other.

20 Claims, 12 Drawing Figures

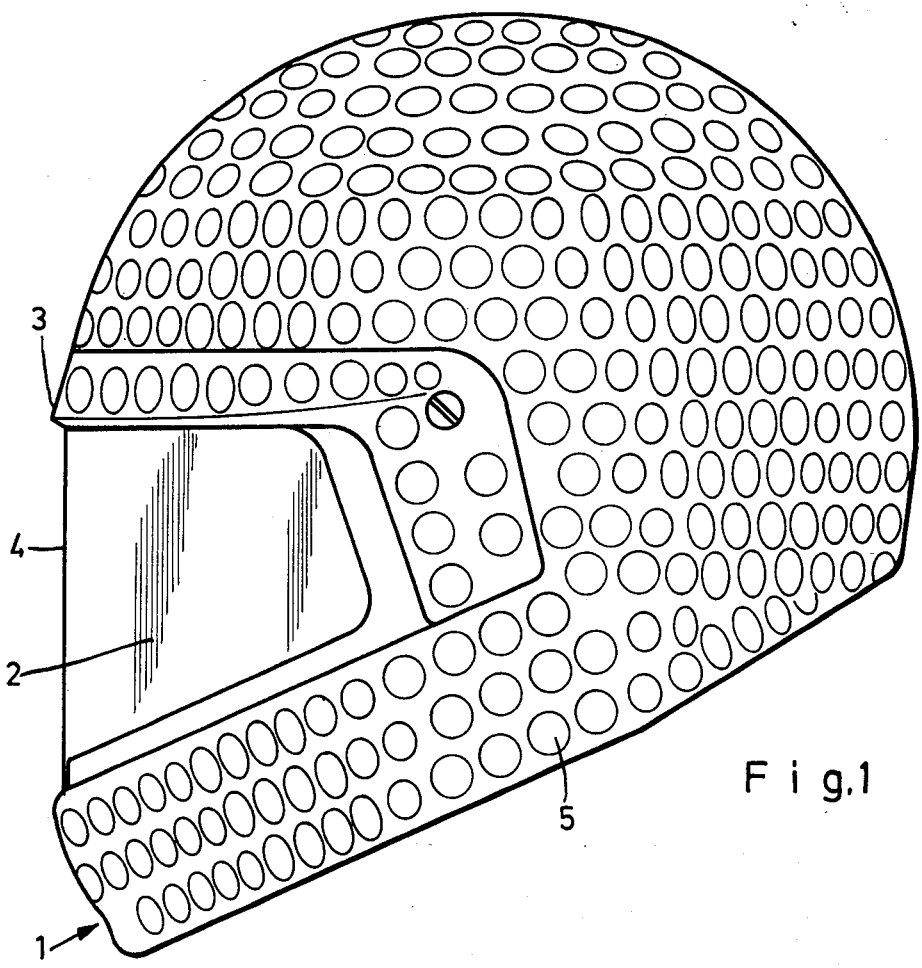
Fig.1
Fig.2
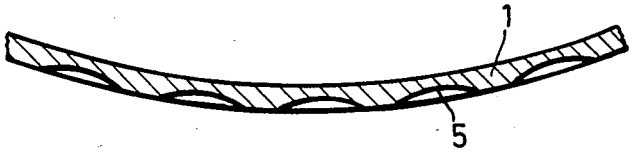

CRASH HELMET

BACKGROUND OF THE INVENTION

The present invention relates to a crash helmet with a spherical cap part.

Crash helmets are used predominantly by motorcycle riders who are trying to protect their heads from injury in the case of an accident. For a considerable period of time, crash helmets have been made mainly from approximately spherical or elongated oval shaped synthetic resin cap parts, which form the outer, impact and shock resistant shell of the crash helmet. The cap part is equipped with a soft inner lining which is fitted to the head of the wearer. In the case of an integral helmet, the cap part includes an integrally formed chin strap to protect the chin area of the wearer. Above the chin strap, the cap is provided with a sight opening which may be covered with a transparent visor.

An integral helmet of this type must have certain minimum dimensions in view of the stringent requirements relating to comfort and impact absorbing properties of the inner lining. Because of its relatively large size, the crash helmet therefore represents an object which offers an appreciable resistance to air, particularly at higher speeds, and consequently exerts a not inconsiderable force on the wearer of the helmet, which must be absorbed by his neck muscles. As a result, during extensive trips at a high speed, the wearer suffers certain fatigue phenomena caused by the stress on the muscles of the neck.

In order to keep the air resistance forces applied to the helmet to a minimum, it has been attempted to provide crash helmets with aerodynamically favorable shapes. In order to obtain a laminar flow with a minimum of friction on the surface of the helmet, the surface of the helmet is made as smooth as possible, which is easily accomplished, in particular with synthetic resin crash helmets.

The possibility of altering the approximately spherical configuration of the cap part to improve its aerodynamics is limited, on the one hand by the shape of the head of the wearer and, on the other, by the necessity of allowing the wearer to turn his head while travelling, to observe the flow of traffic.

SUMMARY OF THE INVENTION

It is therefore an object of the present invention to provide a configuration of a crash helmet whereby the flow resistance of the crash helmet is reduced at high speeds.

It is another object of the present invention to provide a crash helmet as above, wherein no appreciable increase in forces results when the wearer turns to face the side.

In accomplishing the foregoing objects, there has been provided in accordance with the present invention a crash helmet comprising a substantially spherical cap part wherein the external surface of the cap part is provided with a plurality of topographical iregularities or unevenesses arranged adjacently to each other. The irregularities may comprise substantially flat regions or depressions, with circular or polygonal outlines, and may be either distributed with a uniform density over the entire surface of the cap part, or with a reduced density in the frontal region.

Further objects, features and advantages of the present invention will become apparent from the detailed description of preferred embodiments which follows, when considered together with the attached figures of drawing.

BRIEF DESCRIPTION OF THE DRAWINGS

In the drawings:

FIG. 1 shows a lateral elevation of an integral helmet with depressions distributed in a tight packing over the surface;

FIG. 2 shows a section through a piece of the spherical cap part of the helmet of FIG. 1;

DETAILED DESCRIPTION OF PREFERRED EMBODIMENTS

Figure 3:
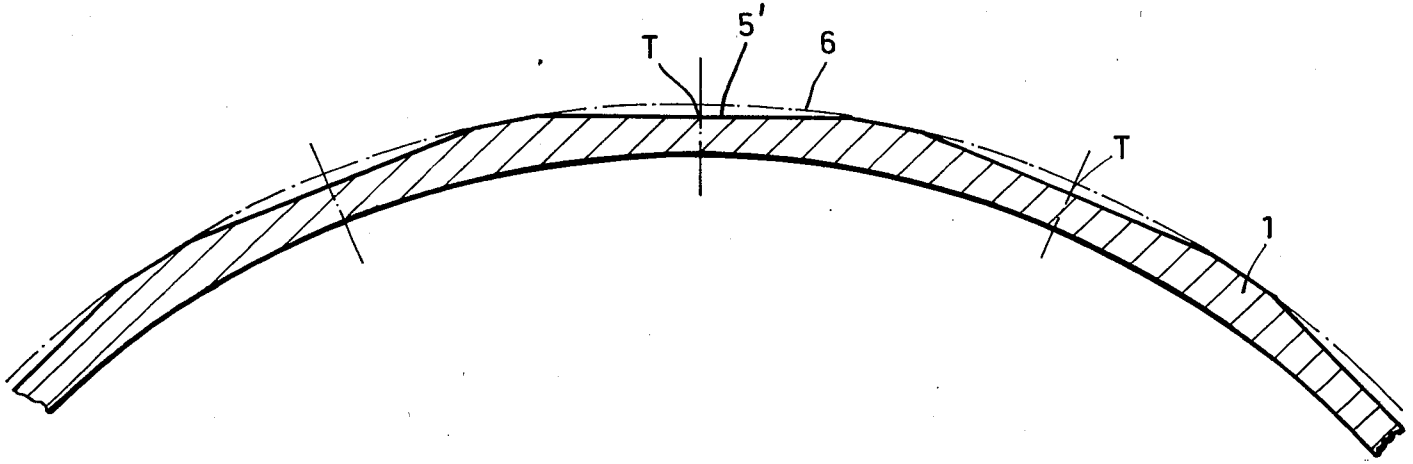
FIG. 3 shows a section corresponding to FIG. 2 through a piece of the spherical cap part of the helmet with unevenness formed merely by flattened regions.

The present invention provides a crash helmet wherein, rather than providing as smooth as possible a surface to induce an extensively laminar flow of air, the helmet is surprisingly provided with an uneven surface formed by elevations and/or recesses, in order to prevent the development of a laminar air flow.

Even though a turbulent flow of air produces a higher frictional resistance, experiments have shown that, at higher speeds with the crash helmet according to the present invention, especially in the case of approximately spherical cap parts, appreciably smaller forces are exerted on the wearer of the helmet, so that the resulting stressing of the neck muscles is reduced. The possibly slightly higher air resistance encountered at low speeds of the crash helmet according to the present invention is practically unnoticeable, since the forces generated at low speeds are very small.

A possible explanation of the surprising effect (i.e., that, in spite of the unevenness on the surface of the cap part of the helmet, a lower flow resistance is generated at high speeds) may be found in the fact that, with a smooth surface, an essentially laminar flow is formed from the front side of the helmet to the height of its greatest diameter, whereas particularly with approximately spherical helmets, a strong turbulence occurs toward the rear side, because a strongly reduced pressure is generated at the rear of the helmet. The difference in pressure between the front and the rear side of the helmet is very high and leads to the occurrence of large forces, which pull the helmet toward the rear. In the case of the cap part according to the present invention, on the other hand, turbulence takes place on the surface, thereby reducing the strength of the underpressure on the rear side of the helmet. The substantial reduction of the difference in pressure between the front side and the rear side of the helmet leads, in spite of the somewhat higher frictional forces on the surface of the helmet, to a reduction of the total forces which are exerted on the helmet and are directed toward the rear.

A satisfactory, desirable turbulence takes place on the surface of the cap part when the uneven surface comprises a plurality of recesses. The recesses are preferably trough-shaped and have a circular cross section, which may however be elliptically distorted for manufacturing reasons. The maximum depth of the recesses and the magnitude of the diameter must be chosen so that, in relation to the size of the helmet, a turbulence is formed which optimally reduces the underpressure at the rear side of the helmet at high speeds without an excessive increase in the frictional resistance due to the flow of air. The reduction of the total rearwardly directed forces generated on the helmet is obtained with recesses distributed over the entire helmet and having a maximum depth of approximately 1.2 to 1.4 mm and a diameter of approximately 15 to 16 mm.

The depressions may be distributed over the entire surface of the helmet in a tightly packed manner. Such a configuration of the helmet permits practically no development of a preferential direction for the helmet. If, for example, the wearer turns his head to observe lateral traffic, there is no appreciable increase in the forces generated on the helmet.

If, for these short term movements of the head, higher forces may be accepted, the total force acting on the helmet during straight line travel may be further reduced by shaping the front side of the helmet with a lesser density of recesses or even a smooth surface. In this case, the depressions need only begin, as viewed from the front, at the point of the largest diameter of the spherical cap part, since the turbulence formation to reduce the underpressure at the rear side of the helmet first commences at this location, while on the front side of the helmet a low friction, possibly laminar flow is created.

The uneven portions according to the invention may be produced very simply by shaping them as flattened portions of the curved cap surface. This already results to some extent in a turbulence of the flow of air. The contour of the flattening may thus be circular or elliptical or even polygonal, where in the latter case a somewhat greater depth of the flattened location may be obtained. In a similar manner, a polygonal depression with converging flat surfaces may be produced, thereby forming a prismatic recession.

FIG. 1 shows an integral helmet with an approximately spherical cap part 1, the sight cutout 2 of which is located in front and may be covered with a transparent (windshield) visor 4 fastened to a visor mounting strap 3.

The outer surface of the cap part 1 is provided over its entire surface with circular depressions 5, spaced apart from each other. The depressions 5 are also found on the visor strap 3, but for optical reasons not on the visor 4.

FIG. 2 details the fact that the depressions 5 are trough-like in shape, i.e., their depth increases steadily from the edge to a maximum depth and decreases from said maximum depth to the opposing edge. Since the depressions have a circular configuration in a top view, they have rotational symmetry around their center.

It is furthermore possible to shape the depressions 5 so that they attain a certain depth relatively rapidly from the edge and that this depth remains approximately constant toward the center of the depression 5 or increases only slightly.

In the embodiment shown in FIGS. 1 and 2, which in actual experiments produced a significant reduction in forces as compared with conventional helmets, the maximum depth of the depressions 5 is from about 1.2 to 1.4 mm and the diameter approximately 15 mm.

FIG. 3 shows an embodiment of the present invention which may be produced very simply from a manufacturing standpoint. The unevenesses herein consist merely of flattened areas 5' in the curved surface of the cap part 1. These flattened areas 5' may be considered depressions, but also elevations when the surface of the helmet is considered as being constituted between the lowest points T.

The contour of these flattened areas 5' may be circular, so that a configuration of the helmet as shown in FIG. 1 is obtained. However, the contours may also be polygonal.

Figure 4:
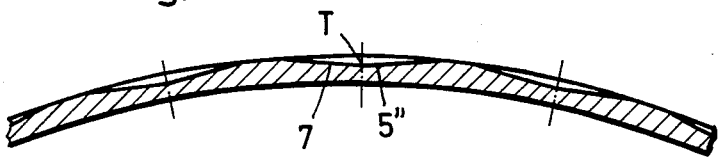
FIG. 4 shows a section through a piece of a spherical cap part of a helmet with prismatic depressions.
Figure 5A:
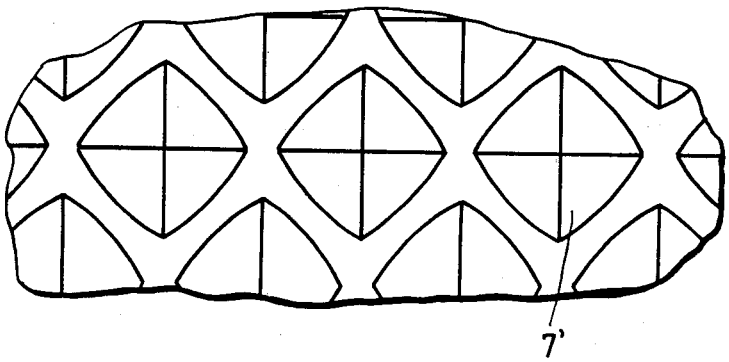
FIGS. 5*a*, 5*b* and 5*c* show three different types of contours of polygonal prismatic depressions.
Figure 5B:
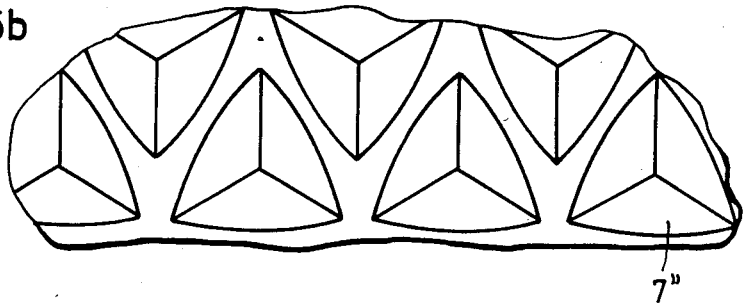
Figure 5C:
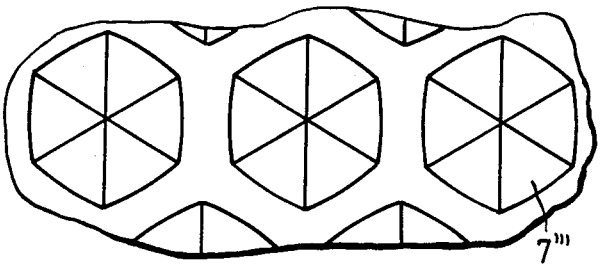
Figure 6:
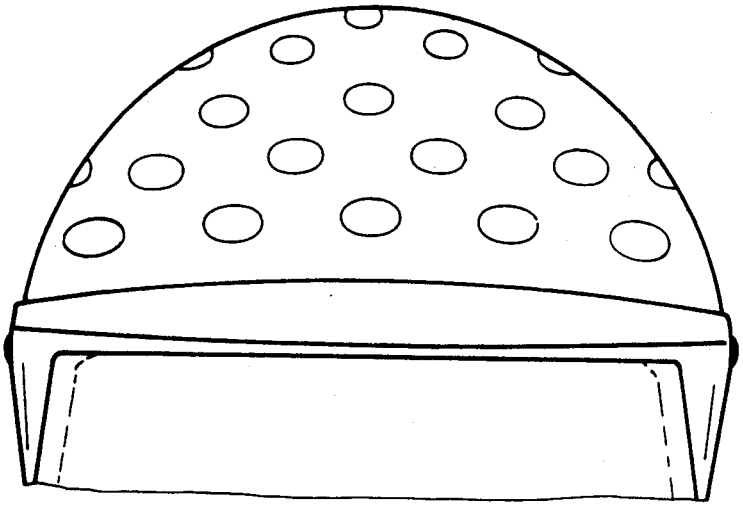
FIG. 6 shows a frontal area of the cap in which the density of depressions is reduced.
Figure 7A:
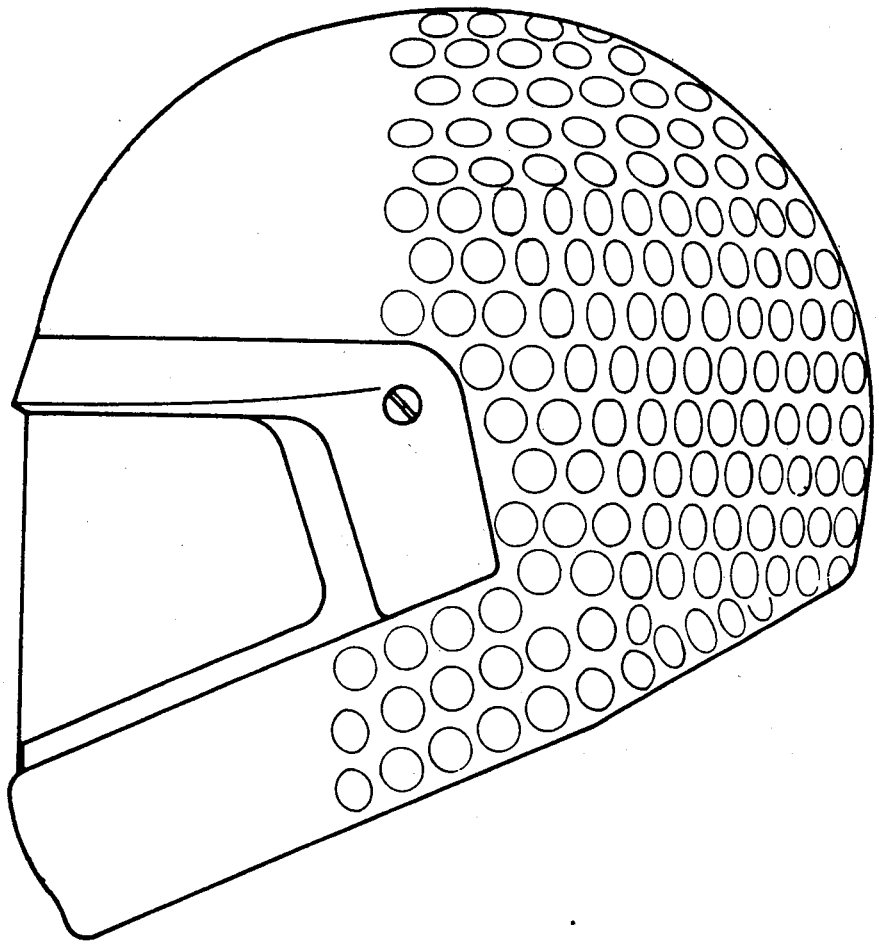
FIG. 7*a* shows a crash helmet wherein no depressions are provided in the frontal area of the cap.
Figure 7B:
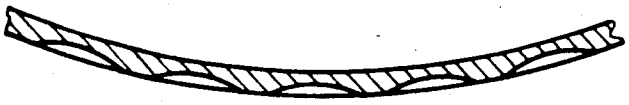
FIG. 7*b* shows a section through a piece of the helmet of FIG. 7*a;*
Figure 8A:
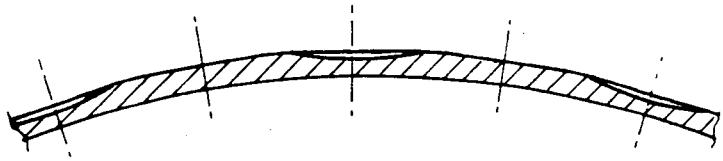
FIG. 8*a* shows a crash helmet wherein the flattened areas comprise an elliptical outline.
Figure 8B:
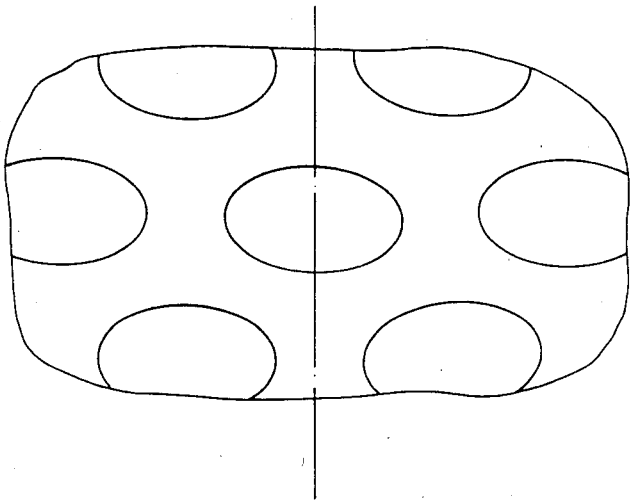
FIG. 8*b* shows a section through a piece of the helmet of FIG. 8*a.*

FIG. 4 shows depressions 5' in a sectional view. The centers of the depressions form the lowest locations T, and each depression comprises flat surfaces 7 inclined toward each other and meeting in a point T. In this manner, prismatic depressions with polygonal contours are formed. Examples of these contours are shown in FIG. 5. FIG. 5*a* shows a rectangular contour with four flat surfaces 7'; FIG. 5*b* illustrates a triangular contour with three flat surfaces 7''; and FIG. 5*c* depicts a hexagonal contour with six flat surfaces 7'''.

What is claimed is:

1. A crash helmet for cyclists, comprising a substantially spherical, impact and shock resistant, synthetic resin cap part, which defines a generally smooth and closed aerodynamically-shaped external surface, wherein the external surface of the cap part comprises a plurality of topographical surface irregularities arranged adjacently to each other, and wherein the irregularities are shaped and spaced so as to create turbulent air flow substantially near the surface of the cap part, for reducing the pressure differential between the front and rear of the helmet caused by high speed air flow over the helmet, while keeping the air resistance to a minimum.

2. A crash helmet according to claim 1, wherein the irregularities comprise depressions.

3. A crash helmet according to claim 2, wherein the depressions are substantially trough-shaped.

4. A crash helmet according to claim 3, wherein the depressions comprise substantially circular outlines.

5. A crash helmet according to claim 1, wherein the irregularities are distributed at spaced locations over the entire surface of the cap part.

6. A crash helmet according to claim 5, wherein the irregularities are distributed in a uniform density over the surface of the cap part.

7. A crash helmet according to claim 2, wherein the density of the depressions is reduced in the frontal area of the cap.

8. A crash helmet according to claim 2, wherein no depressions are provided in the frontal area of the cap.

9. A crash helmet according to claim 2, wherein the depressions have a maximum depth of from about 1.2 to 1.4 mm.

10. A crash helmet according to claim 2, wherein the depressions have a diameter of approximately 15 mm.

11. A crash helmet according to claim 1, wherein the irregularities comprise planar flattened areas of the curved surface of the cap part.

12. A crash helmet according to claim 11, wherein the flattened areas comprise a circular outline.

13. A crash helmet according to claim 11, wherein the flattened areas comprise a polygonal outline.

14. A crash helmet according to claim 2, wherein the depressions comprise a prismatic configuration.

15. A crash helmet according to claim 2, wherein the depressions comprise rectangular contours.

16. A crash helmet according to claim 2, wherein the depressions comprise triangular contours.

17. A crash helmet according to claim 2, wherein the depressions comprise hexagonal contours.

18. A crash helmet according to claim 2, wherein the depressions are radially symmetrical.

19. A crash helmet according to claim 11, wherein the flattened areas comprise an elliptical outline.

20. A crash helmet for cyclists, comprising a substantially spherical, impact and shock resistant, synthetic resin cap part which defines a generally smooth and closed aerodynamically-shaped external surface, said helmet having a front portion facing in the normal direction of cyclist travel and an oppositely oriented rear portion, wherein the external surface of the cap part includes means, distributed over at least the rear portion of said external helmet surface, for reducing the pressure differential between the front and rear of the helmet caused by high speed air flow over the helmet.

* * * * *